United States Patent [19]

Gibbs

[11] 4,386,488

[45] Jun. 7, 1983

[54] VENT APPARATUS FOR INSULATED ROOF STRUCTURES

[76] Inventor: Michael J. Gibbs, 3445 E. Cholla, Phoenix, Ariz. 85028

[21] Appl. No.: 214,478

[22] Filed: Dec. 9, 1980

[51] Int. Cl.[3] ..... E04B 7/00; E04D 1/36; E04D 3/38

[52] U.S. Cl. ..... 52/199; 52/58; 98/122

[58] Field of Search ..... 52/199, 58; 98/122

[56] References Cited

U.S. PATENT DOCUMENTS 1,511,884 10/1924 Heppes ..... 52/58
4,045,922 9/1977 Elliott ..... 52/94

FOREIGN PATENT DOCUMENTS 881850 9/1971 Canada ..... 98/122
546742 7/1942 United Kingdom ..... 98/122

OTHER PUBLICATIONS

"American Builder", Apr. 1963, p. 112.

*Primary Examiner*—Alfred C. Perham
*Attorney, Agent, or Firm*—H. Gordon Shields

[57] ABSTRACT

Vent apparatus usable with insulation for roof structures includes a covering vent for a vent pipe and a flexible gasket which is secured to the insulation, and the vent covering is dimensioned so that either it or the flexible gasket may move with the insulation without resulting in damage to the vent pipe.

7 Claims, 9 Drawing Figures

VENT APPARATUS FOR INSULATED ROOF STRUCTURES

BACKGROUND OF THE INVENTION

1. Field of the Invention

This invention relates to vent pipe coverings, and, more particularly, to coverings for vent pipes extending through roof structures on top of which will be applied insulation.

2. Description of the Prior Art

In general construction, vent pipes, as for plumbing fixtures, extend through the roof structures of the building and upwardly therefrom. They are sealed, appropriately, with flashing, etc. Generally, for relative large buildings, or homes, several vents are ganged together, and a single pipe extends through the roof. In some cases, the vents are covered above the roof to prevent rain, etc., from flowing downwardly through the vent. For other applications, the vents are open, because rain, debris, such as leaves, etc., are not a problem.

For different types of structures, such as mobile homes, the wall structure is relatively thin and each plumbing unit accordingly has its own vent pipe extending upwardly through the roof. The wall structures in such buildings are not large enough, or thick enough, to allow for the ganging of multiple vents, and each unit accordingly has its own vent pipe. Due, in part, to the wall structure, the vent pipes in such buildings are relatively small, or narrow in diameter, and it is accordingly preferred that the vents are shielded above the roof line. It is not untypical for the vents and their protective coverings to extend above the roof line only a very few inches.

Due to the lack of attic space in mobile homes and other, similar structures, only a limited amount of interior insulation is disposed beneath the outer roof covering. The amount of insulation is not sufficient to adequately protect the structure against the intrusion of outside heat in the summer time, or to prevent the loss of interior heat during cold weather. A way of overcoming the lack of interior insulation is to insulate the structure from the outside, as by using flexible or other exterior insulation. Such flexible, exterior insulation is disclosed in U.S. Pat. No. 4,045,922, dated Sept. 6, 1977.

For vent pipes that extend several inches above a roof structure, the insulation is simply sealingly secured about the outer periphery of the vent pipes. When the vent pipes extend upwardly above the exterior insulation, there is generally no further problem. However, when the exterior insulation, such as the flexible insulation disclosed in the U.S. Pat. No. 4,045,922 patent, is secured to a roof through which a vent pipe extends only a very few inches, and where the thickness of the exterior insulation will extend above the original vent, then the vent pipe must be extended, and additional protection must be given to the vent pipe and to its extension.

Heretofore, the sealing of flexible insulation to metal vent pipes has been accomplished primarily in the manner discussed in the U.S. Pat. No. 4,045,922 patent. However, when a vent pipe is made of a polymerized product, such as PVC, ABS, or ABS-DWV, various problems arise. One of the problems is the susceptibility of PVC, and various other polymerized materials, to ultraviolet radiation. The ultraviolet radiation, as from sunlight, causes the PVC material to deteriorate and accordingly to crack, etc.. When exterior insulation is sealingly secured to such PVC pipe which has aged under ultraviolet radiation, a repairman or other person who walks on the roof, and accordingly on the exterior insulation, risks damaging the vent pipe due to the stresses imposed on the vent pipe by the insulation secured thereto.

The apparatus of the present invention overcomes problems of the prior art. It comprises a protective cap made of metal which covers the vent pipe and gasket material which sealingly secures to the insulation material, such that movement of the exterior insulation, and the stresses associated therewith, are not transmitted to the vent. It thus prevents damage to the vent and to the insulation. Moreover, the vent apparatus provides protection for the vent pipe by shielding the pipe from damaging ultraviolet radiation. The original vent covers are removed prior to the installation of the apparatus of the present invention.

SUMMARY OF THE INVENTION

The apparatus described and claimed herein comprises a metallic vent covering and a flexible gasket secured to the metallic vent covering and secured to insulation disposed on a roof structure for protecting the vent pipe and for securing the vent apparatus to the insulation.

Among the objects of the present invention are the following:

To provide new and useful vent apparatus for use with roof insulation;

To provide new and useful apparatus for protecting a vent pipe on a structural roof;

To provide new and useful apparatus for connecting exterior roof insulation to a vent covering;

To provide new and useful vent apparatus securable to a roof and to insulation on the roof; and To provide new and useful vent apparatus for use with exterior insulation on a roof.

DESCRIPTION OF THE PREFERRED EMBODIMENT

Figure 1:
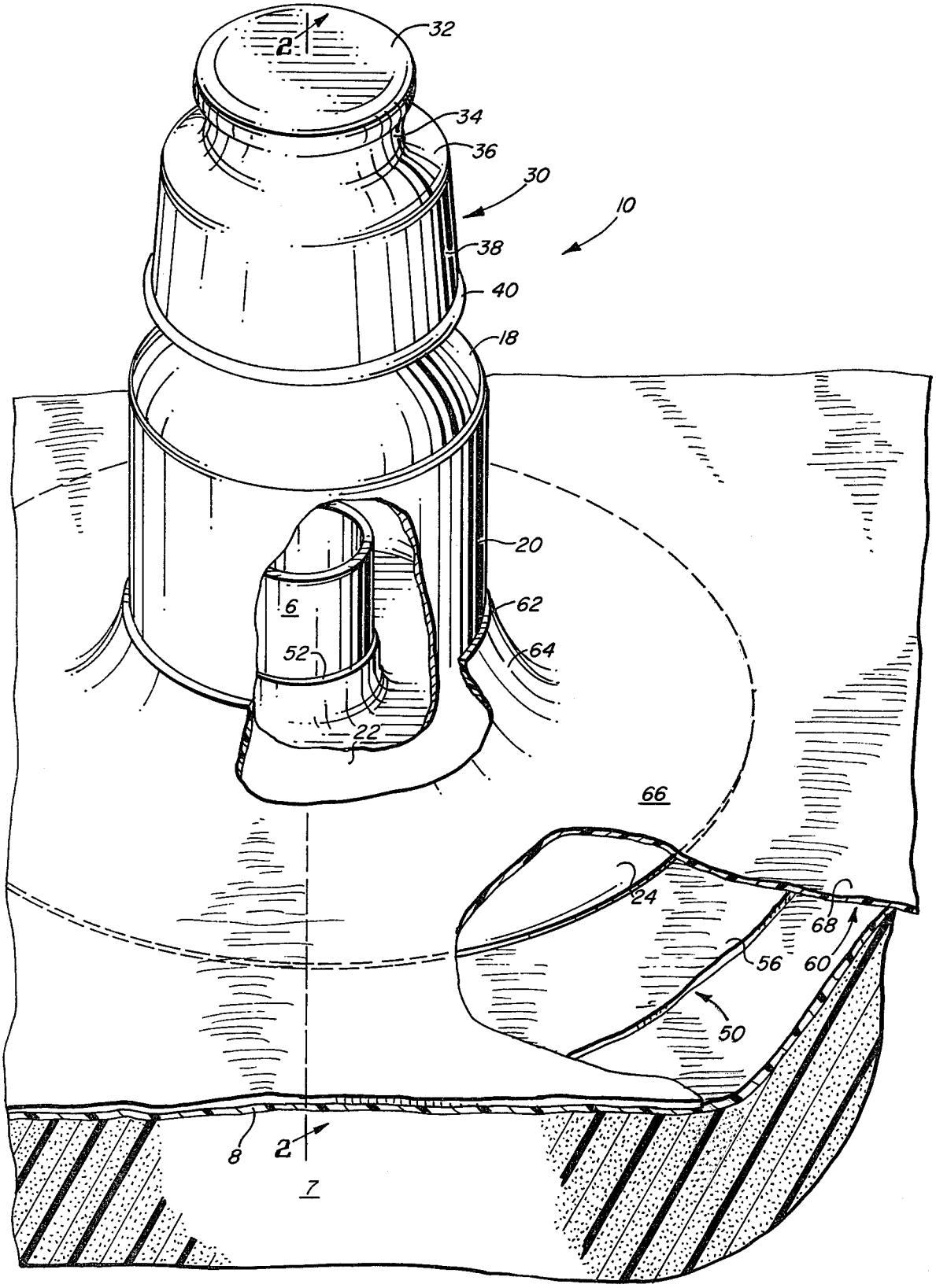
FIG. 1 is a perspective view, with portions cut away, of the apparatus of the present invention.
Figures 2, 3, 4:
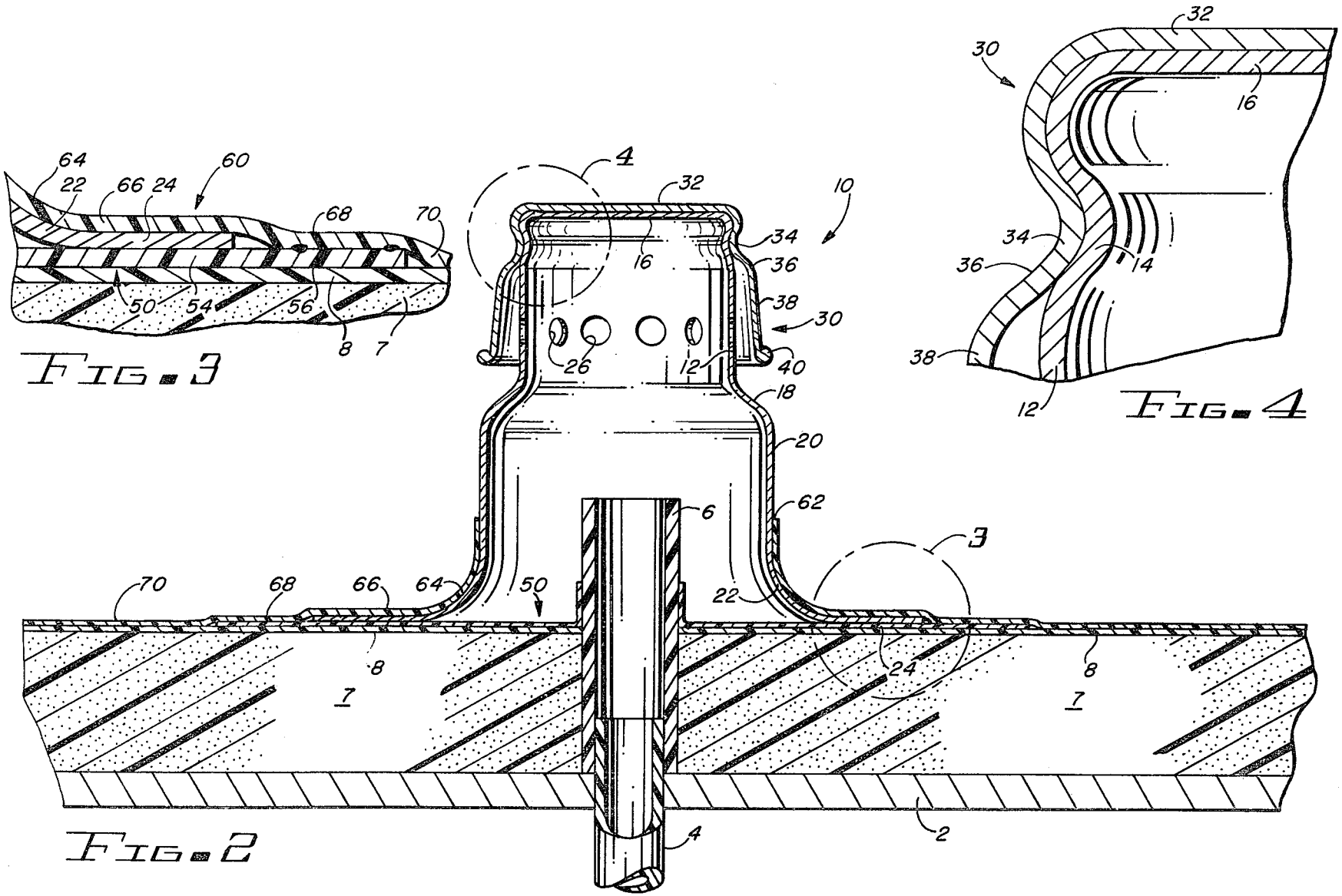
FIG. 2 is a view in partial section of the apparatus of FIG. 1, taken generally along line 2—2 of FIG. 1.
FIG. 3 is an enlarged view of a portion of the apparatus of FIG. 2 taken generally from circle 3 of FIG. 2.
FIG. 4 is an enlarged view in partial section of a portion of the apparatus of FIG. 2 taken generally from circle 4 of FIG. 2.

FIG. 1 is a perspective view of vent apparatus 10 of the present invention, with portions broken away to show various elements of the vent apparatus 10. FIG. 2 is a view in partial section of the apparatus of FIG. 1, taken generally along line 2—2 of FIG. 1. FIG. 2 is in partial section, illustrating the vent apparatus 10 in its use environment. FIG. 3 is an enlarged view in partial section, taken generally from circle 3 of FIG. 2. FIG. 4 is an enlarged view in partial section of a portion of the vent apparatus 10, taken generally from circle 4 of FIG. 2. FIGS. 3 and 4 illustrate various features of the vent apparatus 10. For the following discussion of vent apparatus 10, reference will be made to FIGS. 1, 2, 3, and 4.

The vent apparatus 10 is shown in FIG. 2 as being disposed on a layer of flexible insulation 7, which is in turn disposed on roof decking 2. Extending through an aperture in the roof decking 2 is a vent pipe 4. As is typical in the construction of mobile homes, and the like, a vent pipe, such as the pipe 4, extends above the roof decking only a relatively short distance. The vent pipes, such as the vent pipe 4, which may be made of metal, such as cast iron or galvanized steel, are more generally made of a plastic material, such as PVC, ABS, or ABS-DWV. The vent pipe is generally covered on the outside, or above the roof, by a PVC cap or by a small aluminum cap. The PVC is susceptible to ultraviolet ray damage and the cap is accordingly usually quite brittle and breaks when removed. When exterior insulation, such as the insulation 7 of FIG. 2, is placed on the roof decking 2, the original cap (not shown) covering the vent pipe 4 is removed and must be replaced after the insulation is secured to the roof.

Since the vent pipe 4 extends only a relatively short distance above the roof 2, the thickness of the insulation layer 7 is invariably greater than the height that the vent pipe extends above the roof. There is an extension 6 shown in FIG. 2 as being disposed about, and secured to, the vent pipe 4 above the roof deck 2. The length of the vent pipe extension 6 is dimensioned so as to be greater than the thickness of the insulation 7. Thus, the vent pipe extension 6 terminates above the top of the exterior insulation 7.

In order to adequately protect the vent pipe 4 and its extension 6, the vent apparatus 10 is disposed on top of the layer 7 of insulation and about the extension 6. The vent apparatus 10 is appropriately secured to the insulation 7 so as to preclude the entrance of moisture, etc., into the extension 6 and the pipe 4. The insulation 7 includes a top or weathering surface 8. The weathering surface 8 is an outer layer, usually flexible, which covers the insulative layer. The flexible outer or weathering surface layer is appropriately bonded to the insulative layer, whether the insulative layer is flexible or whether the insulative layer is rigid.

The vent apparatus 10 includes two portions, a metal portion preferably made of aluminum, and a gasket portion, preferably made of flexible material impervious to moisture and not subject to deterioration from ultraviolet radiation. The aluminum is, of course, generally impervious to damage from solar radiation, it does not rust, and it is relatively lightweight and inexpensive to fabricate.

The vent apparatus 10 includes an upper cylindrical portion 12, which is spaced generally above the top of the extension 6. An annular groove 14 extends radially inwardly at the top of the cylindrical portion 12, adjacent to where the cylindrical portion 12 is closed by a top end wall 16. At the bottom end of the upper cylindrical portion 12 is an outwardly flaring or middle portion 18. The flaring portion 18 extends downwardly and outwardly from the bottom of the upper cylindrical portion 12. It is a transition area or portion between the upper cylindrical portion 12 and a lower cylindrical portion 20. The diameter of the lower cylindrical portion 20 is greater than that of the upper cylindrical portion 12. The height or length of the lower cylindrical portion 20 is also greater than the height or length of the upper cylindrical portion 12. The vent extension 6 is disposed within the lower cylindrical portion 20.

At the bottom or lower end of the lower cylindrical portion 20 is a lower, outwardly flaring portion 22, which comprises a transition from the lower cylindrical portion 20 to a flat, bottom apron 24. The apron 24 extends radially outwardly, and is substantially perpendicular to the longitudinal or cylindrical axes of the cylindrical portions 20 and 12.

A cap 30 is disposed on the top of the upper cylindrical portion 12. The cap 30 includes an end wall 32 which, as best shown in FIG. 4, is disposed on the top end wall 16 of the upper cylinder 12. Spaced apart a relatively short distance downwardly, axially, with respect to the end wall 32, is an annular groove 34. The annular groove 34 mates with the annular groove 14 of the upper cylinder portion 12 to secure the cap 30 to the end wall 16 of the upper cylinder 12. If desired, other appropriate sealing means, such as rivets, may be used to secure the cap 30 to the upper cylinder 12, as by securing together the end walls 16 and 32.

Downwardly, axially, from the annular groove 34, is an outwardly flaring portion 36. The outwardly flared portion 36 comprises a transition between the upper portion of the cap 30 and a skirt 38. The skirt 38 is of a generally cylindrical configuration, but it tapers outwardly, from the flared portion 36 as it extends downwardly. The skirt 38 terminates in a rim 40. The rim 40, and the bottom of the skirt 36, is spaced outwardy from the cylinder 12, and slightly above the upper portion of the outwardly flaring middle portion 18. This is best shown in FIGS. 1 and 2.

For ventilation purposes, a plurality of vent holes or apertures 26 extend through the cylindrical portion 12 to allow communication from within the vent apparatus 10 to the outside, ambient, air.

For sealing the vent apparatus 10 to the insulation 7, a pair of flexible gaskets are used. The gaskets are generally impervious to moisture and to damage by solar radiation, and remain flexible throughout their life. The flexibility of the gaskets thus allows the movement of the insulation 7, to which the apparatus is secured, and a corresponding movement of the vent apparatus 10, without damage either to the insulation or to the vent apparatus, and without a separation of the bonding between them. Moreover, as may be understood from FIGS. 1 and 2, since the diameter of the cylinder 20 is substantially greater than the diameter of the vent extension 6, the insulation 7 and the vent apparatus 10 may move relative to the extension 6 without coming in contact with either the vent 4 or the extension 6, and accordingly without damaging the vent 4 or the extension 6.

The two gaskets include a bottom gasket 50 and an upper gasket 60, both of which are made of the same flexible material, such as a plastic or silicon rubber type material. As best shown in FIG. 1, the bottom gasket 50 is disposed beneath the lower cylinder 20 and the apron 24. The gasket 50 includes an inner aperture 52 which is disposed about the extension 6. The aperture 52 is cut with a diameter which is substantially less than the outer diameter of the extension 6, and thus the aperture 52 has to stretch and expand as it receives the extension 6. This provides a relatively tight seal between the gasket 50 and the extension 6.

The bottom gasket 50 is generally of a circular configuration, and its overall diameter is somewhat greater than the overall diameter of the apron 24. A mid-portion 54 of the gasket 50 is disposed beneath the apron 24, as best shown in FIG. 3. An outer portion 56 of the bottom gasket extends outwardly, beyond the apron 24. This is also best shown in FIG. 3. The apron 24 is shown in FIG. 3 as disposed on the gasket 50, with the mid-portion 54 of the gasket 50 disposed beneath the apron 24, and the outer portion 56 is shown extending radially outwardly beyond the outer periphery of the apron 24.

The upper gasket 60 is, as discussed above, preferably made out of the same material which the bottom or lower gakset 60 is made out of. The configuration of the upper gasket 60 may be circular or square, or any other appropriate configuration, as desired. The upper gasket 60 includes an inner aperture 62 which is disposed about the lower portion of the lower cylinder 20, and it covers the lower, outwardly flared, portion 22 and the upper portion of the apron 24. The gasket 60 terminates outwardly beyond the apron 24 and outwardly beyond the outer portion 56 of the lower or bottom gasket 50. Since the upper gasket 60 is flexible or stretchable, like the lower gasket 50, the aperture 62 is originally cut substantially less in diameter, or smaller in diameter, than the outer diameter of the cylinder 20. Thus, when the cylinder is received into the aperture 62 of the gasket 60, the aperture and the gasket stretch to allow the cylinder to extend through the gasket, but the elasticity of the gasket provides a relatively tight seal between the gasket 60 and the cylinder 20. It will be noted that the material out of which both gaskets 50 and 60 are made retain their stretchability and their elasticity throughout their life in order to maintain the relatively tight engagement between the gaskets and their respective cylindrical elements, such as the pipe extension 6 and the cylinder 20.

The upper gasket 60 includes an upper portion 64 which extends downwardly from the aperture 62 and generally covers the lower portion of the cylinder 20 and the outwardly flaring or transition portion 22. Outwardly from the upper portion 64 is a mid-portion 66 which is disposed generally on top of the apron 24. The gasket 60 also includes a portion 68 which is radially outwardly from the mid-portion 66 and is generally coextensive with the outer portion 56 of the gasket 50. The portion 68 may be described as a "sealing" portion. Outwardly from the sealing portion 68 is an outer portion 70. The outer portion 70 extends radially outwardly from the sealing portion, and may extend as far as desired for appropriate securing to the surface 8.

As best shown in FIG. 3, the outer portion 56 of the bottom gasket 50 and the sealing portion 68 of the upper gasket 60 are shown disposed against each other and are appropriately sealed together, preferably as by heat welding. The lower portion of the cylinder 20 and the transition portion 22 and the apron 24 of the vent apparatus 10 are thus disposed between the gaskets 50 and 60. The outer portion 70 of the upper gasket 60 may be appropriately secured to the top or weathering surface or layer 8 of the insulation 7. When the upper gasket 60 is thus secured on the layer 8, there is a bonding of the vent apparatus 10 to the layer 8 which prevents moisture from creeping into the interior of the vent apparatus 10 and accordingly into the vent pipe extension 6 and its vent pipe 4. However, moisture, etc., may flow out of the vent apparatus 10 through the apertures or holes 26. Moisture is prevented from entering into the vent apparatus 10 through the holes 26 by the skirt 38 of the cap 30.

If, by chance, moisture were to enter into the vent apparatus 10, the moisture would have to build to a height sufficient to reach the top or upper rim of the vent pipe extension 6 in order to flow downwardly into the vent pipe 4. Other than through the apertures 26, moisture would have to work its way between the cylinder 20 and the aperture 62 of the gasket 60, downwardly between the gasket upper portion 64 and its mid-portion 66, around the bottom of the apron 24, and between the apron 24 and the midportion 54 of the gasket 50 and into the interior of the vent apparatus 10 before it could begin to accumulate within the interior of the vent apparatus 10. Once within the vent apparatus 10, the moisture would then have to penetrate between the aperture 52 and the vent extension 6 and through the layer 8 in order to have access to the insulation 7, and to the roof decking 2 and about the vent pipe 4 to the interior of the structure to which the roof decking 2 is applied. In the alternative, the moisture would have to accumulate within the interior of the vent apparatus 10 to above the height of the extension 6 in order to flow downwardly through the vent 4.

Since both gaskets 50 and 60 are flexible, movement of the vent cap 10 about the vent pipe 4 and its extension 6, will not result in harm to the sealing qualities or abilities or capacities of the gaskets with respect to the entrance of moisture into the interior of the apparatus 10. Moreover, movement of the insulation 7, if such insulation is flexible, with the vent apparatus 10 secured thereto, and which movement results in movement of the vent apparatus 10, will have no effect on the sealing abilities of the vent apparatus 10 with respect to the vent pipe 4 and its extension 6.

Figure 5:
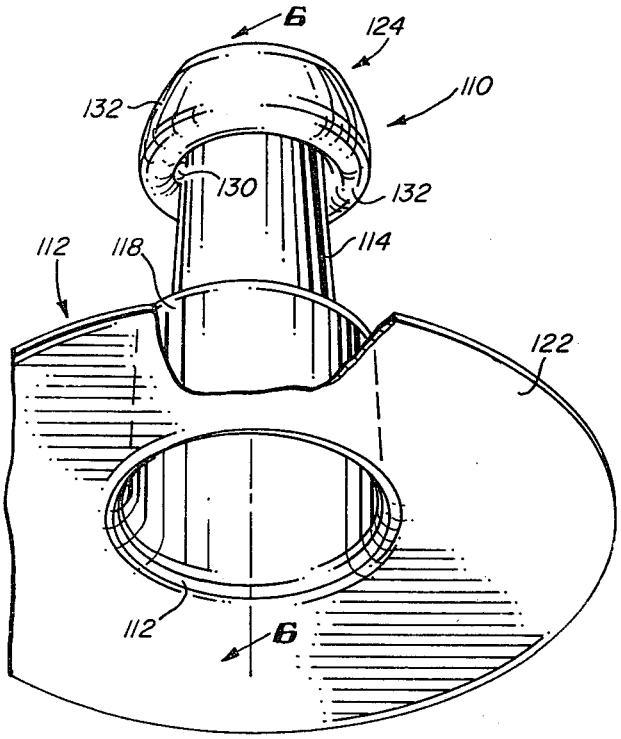
FIG. 5 is a bottom perspective view of another embodiment of the apparatus of the present invention.
Figure 7:
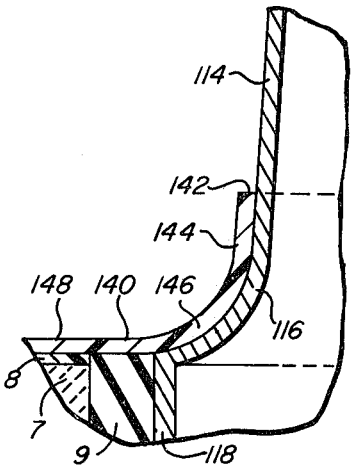
FIG. 7 is an enlarged view in partial section of a portion of the apparatus of FIG. 6, taken generally from circle 7 of FIG. 6.
Figure 8:
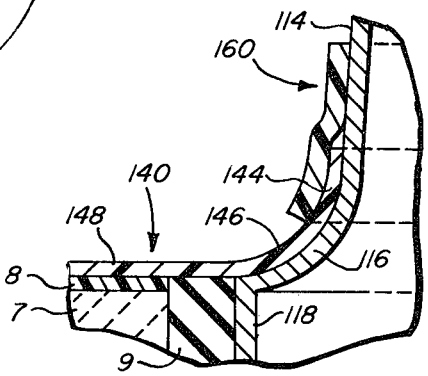
FIG. 8 is a view in partial section of the apparatus of FIG. 7 showing a modification thereof.
Figure 9:
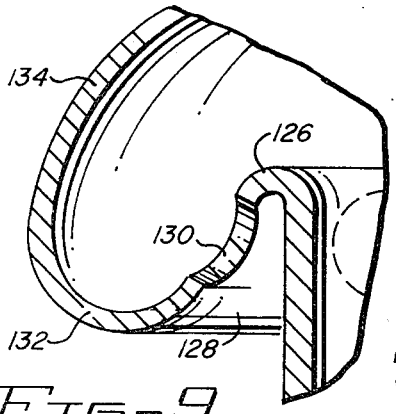
FIG. 9 is an enlarged view in partial section of a portion of the apparatus of FIG. 6, taken generally from circle 9 of FIG. 6.
Figure 6:
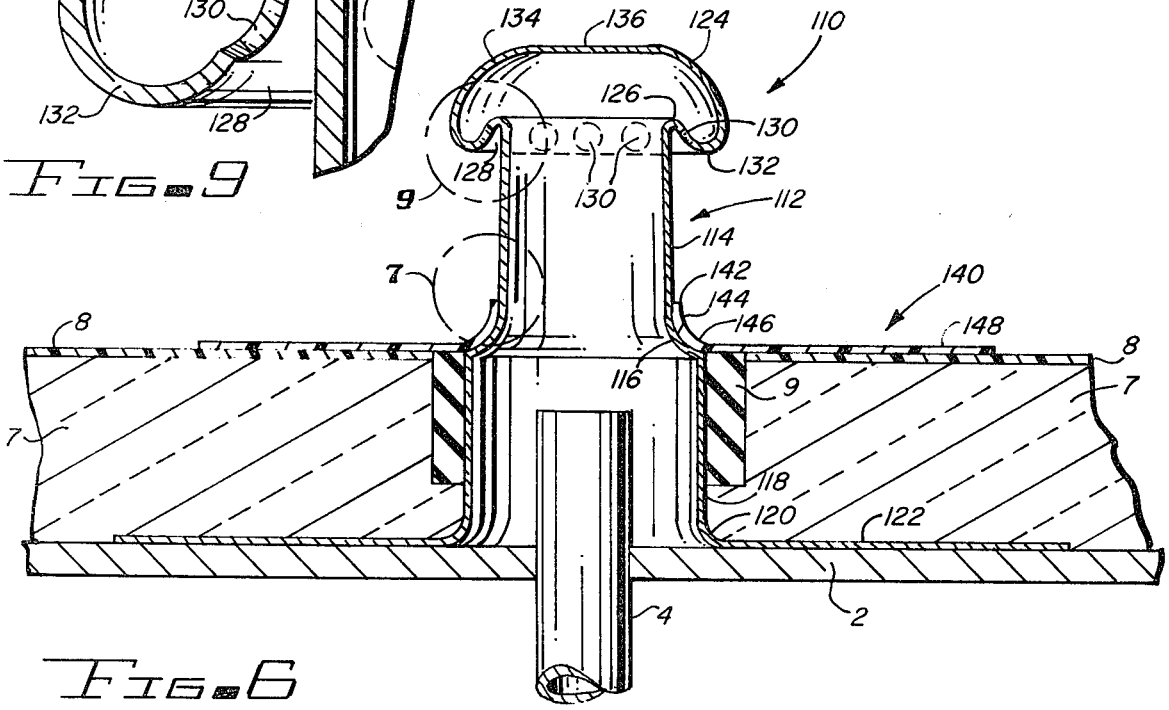
FIG. 6 is a view in partial section of the apparatus of FIG. 5, taken generally along line 6—6 of FIG. 5.

FIG. 5 is a perspective view of an alternate embodiment of a portion of the apparatus of FIGS. 1–4. It comprises a single piece metallic portion of alternate vent apparatus 10 which is used with a flexible gasket. FIG. 6 is a view in partial section of the complete vent apparatus 110, including both the metal portion and the gasket portion taken generally along line 6—6 of FIG. 5, and illustrating the vent apparatus 110 in a use environment. FIG. 7 is an enlarged view in parallel section of a portion of the vent apparatus 110, taken generally from circle 7 of FIG. 6. FIG. 8 is a view in partial section of the apparatus of FIG. 7, illustrating an alternate embodiment thereof. FIG. 9 is an enlarged view in partial section of a portion of the apparatus 110, taken generally from circle 9 of FIG. 6. For the following discussion, reference will be made to FIGS. 5, 6, 7, 8, and 9.

The vent apparatus 110 includes a one piece metallic portion 112, with the one piece metallic portion 112 including four primary elements, an upper cylinder 114, a lower cylinder 118, an apron 122, and a cap 124.

The upper cylinder 114 is of a generally cylindrical configuration, although it may taper slightly, and accordingly may comprise a section or portion of a cone having a relatively slight taper. Similarly, the lower cylindrical portion 118 may include a slight taper and may accordingly be a section of a cone with a very slight taper. Between the upper cylindrical portion 114 and the lower cylindrical portion 118 is a transition area or portion 116 which extends outwardly and downwardly from the bottom of the upper cylinder 114 to the lower cylinder 118. The upper cylinder 114 is of a lesser diameter than the lower portion 118. The transition area 116 extends between the two portions and defines a relatively smooth outward and downward flare.

At the bottom of the lower cylindrical portion 118 is a lower transitional area 122 which extends from the bottom of the lower cylindrical portion 118 to the apron 122. The apron is relatively flat and is circular in configuration, as best shown in FIG. 5. The lower transitional area 120 extends outwardly from the bottom of the lower cylindrical portion 118. The apron 122 is generally flat, and as best shown in FIG. 2, extends outwardly from the upper and lower cylindrical portions, generally coaxially therewith.

The cap 124 includes an upper reverse portion 126 which extends from the top or upper portion of the upper cylinder 114. The reverse portion 126 extends in a generally inverted "V" or "U" between the cylinder 114 and a downwardly and outwardly extending sloping wall 128. A plurality of apertures 130 extends through the sloping wall 128. The length of the sloping wall is relatively short, and from the bottom of the sloping wall 128, there is a second reversing portion 132, which may be defined as a lower reversing portion. The lower reversing portion 132 is also of a generally "U" shaped configuration, and it defines a transition between the outwardly sloping wall 128 and an outer wall 134. The outer wall 134 slopes upwardly and generally inwardly to where it is connected to a top wall 136.

The apertures 130 which permit communication between the inside of the metallic portion 112 and the outside, ambient air, are protected from rain, and the like, by the top wall 136 and the outer wall 134. Any moisture which finds its way into the cap 124 through the apertures 130 collects in the lower portion of the cap, namely in the lower reverse portion 132, before it can move into the interior of the cylindrical portions 114 and 118. In the process of overflowing the lower reverse portion 132, and between the walls 128 and 134, the moisture would necessarily flow outwardly through the apertures 130 before moving over the upper reverse curve portion 136 and down through the cylinder 114.

In FIG. 6, it will be noted that the apron 122 of the metallic portion 112 is disposed directly on top of the roof decking 2, and about the vent pipe 4, which is in turn disposed on the roof decking 2 and also on the apron 122, and about the lower cylindrical portion 118 of the apparatus 110. The vent pipe extension 6, as shown in FIGS. 1, 2, and 5, is not needed. A collar 9, which is preferably of a foam or other elastomeric material, may be disposed about the lower cylinder 118 to provide a seal between the apparatus 110 and the surface 8, if desired. The insulation 7 is shown abutted up against the collar or gasket 9, which is in turn disposed about the cylindrical portion 118. If the gasket 9 is not used, the insulation 7, including its weather surface 8, is abutted against the metallic portion 112, and preferably against the lower cylindrical portion 118 thereof. Appropriate sealing may be accomplished between the cylinder 118, the gasket 9, and the surface 8. In the embodiment of the vent apparatus 110, as employed in FIG. 6, the bottom gasket, illustrated in FIGS. 1, 2, and 3, is eliminated. However, a gasket 140, comparable to the upper gasket 60 of FIGS. 1, 2, and 3 is employed in the apparatus 110. The gasket 140 is preferably made of the same type of material as the gaskets 50 and 60 of FIGS. 1, 2, and 3, namely a "hypalon" type substance which is flexible, generally elastic, and relatively impervious to moisture and to damage by solar radiation.

As best shown in FIG. 7, the gasket 140 includes an inner aperture 142 which extends over the lower portion of the cylinder 114 and is disposed thereagainst by its inherent elasticity, as discussed above in conjunction with the embodiment of FIGS. 1–3. The gasket 140 extends downwardly and outwardly from the aperture 142, and it includes an upper portion 144, a mid portion 146, and an outer portion 148. The outer portion 148 is disposed on, and appropriately sealed to, the flexible layer 8, substantially as discussed above in conjunction with FIG. 2. If desired, the gasket 140 may extend upwardly along the upper cylindrical portion 114, and terminate under the cap 124.

To insure a seal between the gasket 140 and the lower cylinder 118 of the metallic portion 112, an additional element, such as flashing 160, may be used. The flashing or sealing element 160 is shown in FIG. 8. The element 160 is disposed about the outer periphery of the upper cylinder 114 and over the upper portion 144 of the gasket 140. The flashing 160 may be a metallic collar or it may be an additional, flexible element, similar to the gasket 140. In FIG. 8, the flashing 160 is shown as a flexible sealing element. However, it will be understood that a metallic element may also be used. It will also be understood that the gasket 140 may be appropriately sealed to the metallic portion 112, if desired, and that the flashing 160 may be appropriately sealed or secured to both the rigid metallic cover 112 and the gasket 140.

It will be noted that the apparatus 110 of FIGS. 5–9 is relatively immobile once it is disposed on the roof decking 2 and secured to the insulation 7. This is a contrasting situation, with respect to the installation, from the vent apparatus 10 of FIGS. 1–4. Obviously, the vent apparatus 10 of FIGS. 1–4 may also be disposed on the roof decking, as shown in FIG. 6, and the vent apparatus 110 may be disposed on top of the insulation layer 8, with two gaskets secured thereto, such as the gaskets 50 and 60 illustrated and discussed in conjunction with FIGS. 1–3. That is, if the vent apparatus 10 were disposed on the roof decking 2, the use of the lower gasket 50 would be obviated, and the upper gasket 60 alone would be used. The upper gasket 60 would not be disposed as low on the lower cylinder 20 as is shown in FIGS. 1 and 2. Rather, the gasket 60 would be disposed higher on the lower cylinder 20, or wherever convenient with respect to the thickness of the insulation 7 disposed against it. Similarly, the use of the single piece metallic cap portion 112 of the vent apparatus 110 could be employed, as best shown in FIGS. 2 and 3, using two gaskets, an upper and a lower gasket, as discussed in conjunction with FIGS. 1–3, above. The element 112 would accordingly be disposed on top of the surface 8 of the insulation 7, as best shown in FIGS. 2 and 3.

Regardless of how the vent apparatus of the present invention is disposed with respect to a roof, a vent pipe, and exterior insulation, the vent apparatus will be secured to the insulation by means of a flexible gasket to allow movement of the insulation and the gasket without harming the seal effected by the vent apparatus and the insulation to protect a vent pipe disposed within the vent apparatus.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Vent apparatus for an insulated roof structure having a vent pipe extending through the roof structure comprising, in combination:
   - cylinder means disposed over the vent pipe;
   - cap means covering the cylinder means;
   - aperture means for venting the cylinder means and the vent pipe;
   - gasket means secured to the cylinder means and to the roof structure, and including
     - a first portion disposed about the cylinder means,
     - a second portion extending outwardly away from the cylinder means and secured to the roof structure, and
     - a third portion disposed about the vent pipe and secured to the second portion.

2. The apparatus of claim 1 in which the aperture means extends through the cylinder means.

3. The apparatus of claim 1 in which the aperture means extends through the cap means.

4. The apparatus of claim 1 in which the cylinder means includes an upper cylindrical portion secured to the cap means, a lower cylindrical portion secured to the upper cylindrical portion, and an apron portion secured to the lower cylindrical portion and disposed on the roof structure.

5. Vent apparatus for a roof structure including roof decking, insulation disposed on the roof decking, and a vent pipe extending through the roof decking and the insulation, comprising, in combination:
   - cylinder means disposed over the vent pipe;
   - cap means secured to the cylinder means;
   - apron means disposed on the insulation connected to the cylinder means and extending outwardly therefrom;
   - aperture means for venting the vent pipe and the cylinder means; and
   - gasket means for securing the cylinder means to the roof structure, including
     - a first portion disposed about the cylinder means,
     - a second portion connected to the first portion and disposed on the apron means,
     - a third portion connected to the second portion and disposed on and secured to the insulation, and
   - a fourth portion disposed about the vent pipe, beneath the apron means, and secured to the third portion.

6. The apparatus of claim 5 in which the apron means is disposed on the roof decking and the insulation is disposed about the cylinder means.

7. The apparatus of claim 5 in which the cylinder means includes an upper cylinder portion secured to the cap means, and a lower cylinder portion secured to the upper cylinder portion and to the apron means, and the apron means comprises a generally flat portion extending outwardly from the lower cylinder portion.

* * * * *